US006889950B2

(12) United States Patent
Evanoff

(10) Patent No.: US 6,889,950 B2
(45) Date of Patent: May 10, 2005

(54) PORTABLE MUSIC STAND TOP AND CASE COMBINED

(76) Inventor: Robert J. Evanoff, 6132 Paul Ave. N., Stillwater, MN (US) 55082

( * ) Notice: Subject to any disclaimer, the term of this patent is extended or adjusted under 35 U.S.C. 154(b) by 0 days.

(21) Appl. No.: 10/202,356

(22) Filed: Jul. 24, 2002

(65) Prior Publication Data

US 2003/0019995 A1 Jan. 30, 2003

Related U.S. Application Data

(60) Provisional application No. 60/308,258, filed on Jul. 25, 2001.

(51) Int. Cl.[7] ..... A47B 97/04
(52) U.S. Cl. ..... 248/441.1; 248/444
(58) Field of Search ..... 248/441.1, 443, 248/444, 444.1, 161, 157

(56) References Cited

U.S. PATENT DOCUMENTS 3,695,452 A * 10/1972 Surman ..... 211/4
4,243,249 A * 1/1981 Goss ..... 281/51
4,356,854 A * 11/1982 McGee ..... 383/29
4,655,427 A * 4/1987 Lamb ..... 248/460
4,726,556 A * 2/1988 Weir ..... 248/454
5,104,085 A * 4/1992 Brice ..... 248/441.1
5,287,815 A * 2/1994 Gross ..... 108/50.14
5,356,109 A * 10/1994 Biasini ..... 248/448
5,488,890 A * 2/1996 Biasini ..... 84/280
5,564,661 A 10/1996 Gershon ..... 248/167
5,713,553 A 2/1998 Cooper ..... 248/460
5,791,624 A 8/1998 Fedrick ..... 248/460
5,941,496 A 8/1999 Banner ..... 248/459
5,971,101 A * 10/1999 Taggart ..... 182/129
5,979,856 A 11/1999 Hsu ..... 248/441.1
5,988,383 A * 11/1999 Armstrong ..... 206/373
6,168,126 B1 * 1/2001 Stafford ..... 248/276.1
6,264,161 B1 * 7/2001 Waggoner ..... 248/460
6,293,511 B1 9/2001 Shepherd ..... 248/441.1
6,563,036 B1 * 5/2003 Biasini ..... 84/453

* cited by examiner

*Primary Examiner*—Leslie A. Braun
*Assistant Examiner*—A. Joseph Wujciak
(74) *Attorney, Agent, or Firm*—Dicke, Billig, & Czaja, PLLC

(57) ABSTRACT

A portable music stand intended for tabletop use with adaptability to a tripod support base is provided. The stand has the integral capacity to store orchestral size music scores as well as accessories. Its design provides means to transport a tripod support base, writing utensils and make for easy carrying by way of a removable shoulder strap. Music securing straps and an extended height range capacity make for an improved portable music stand.

44 Claims, 7 Drawing Sheets

FIGURE ONE
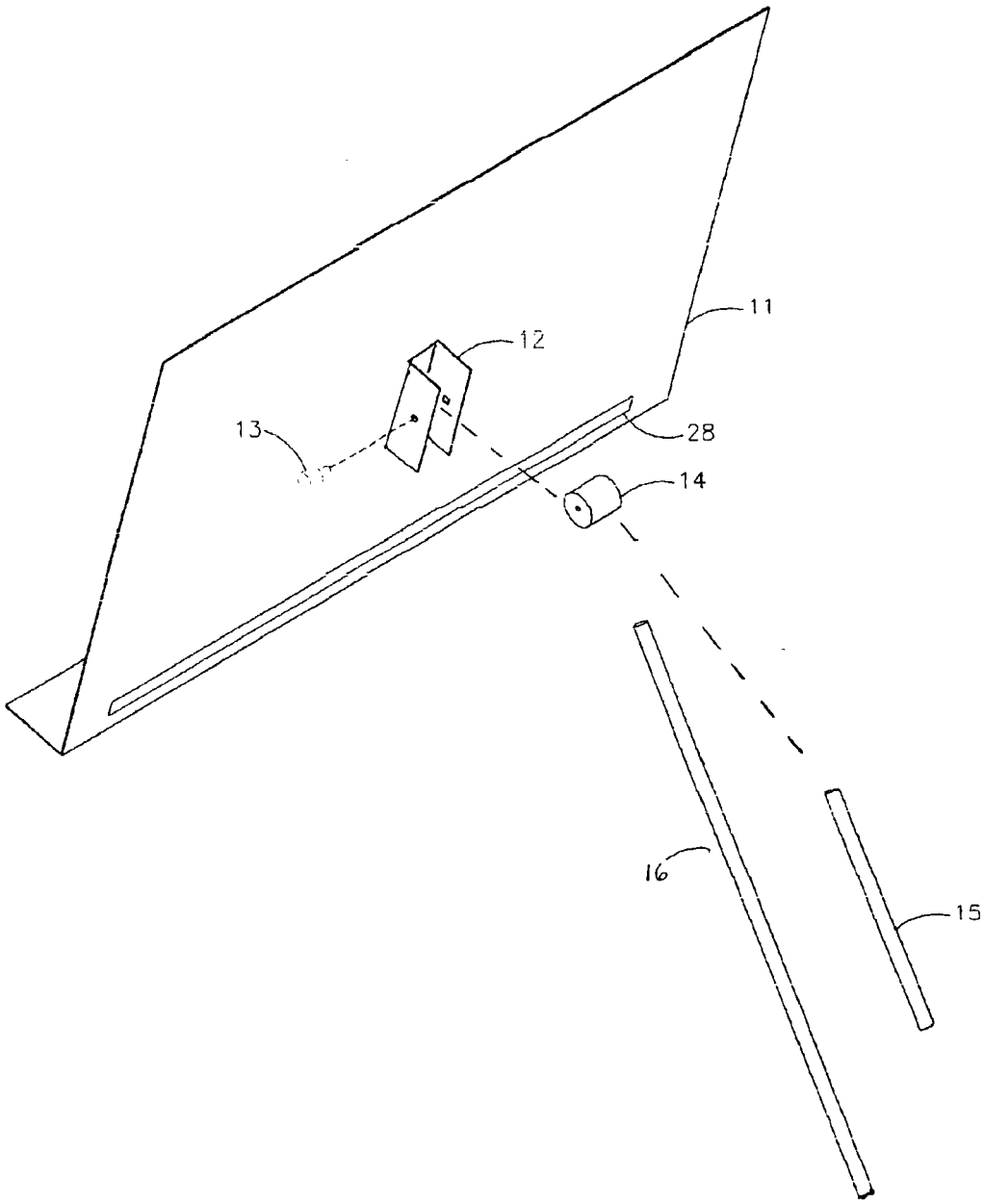

FIGURE TWO
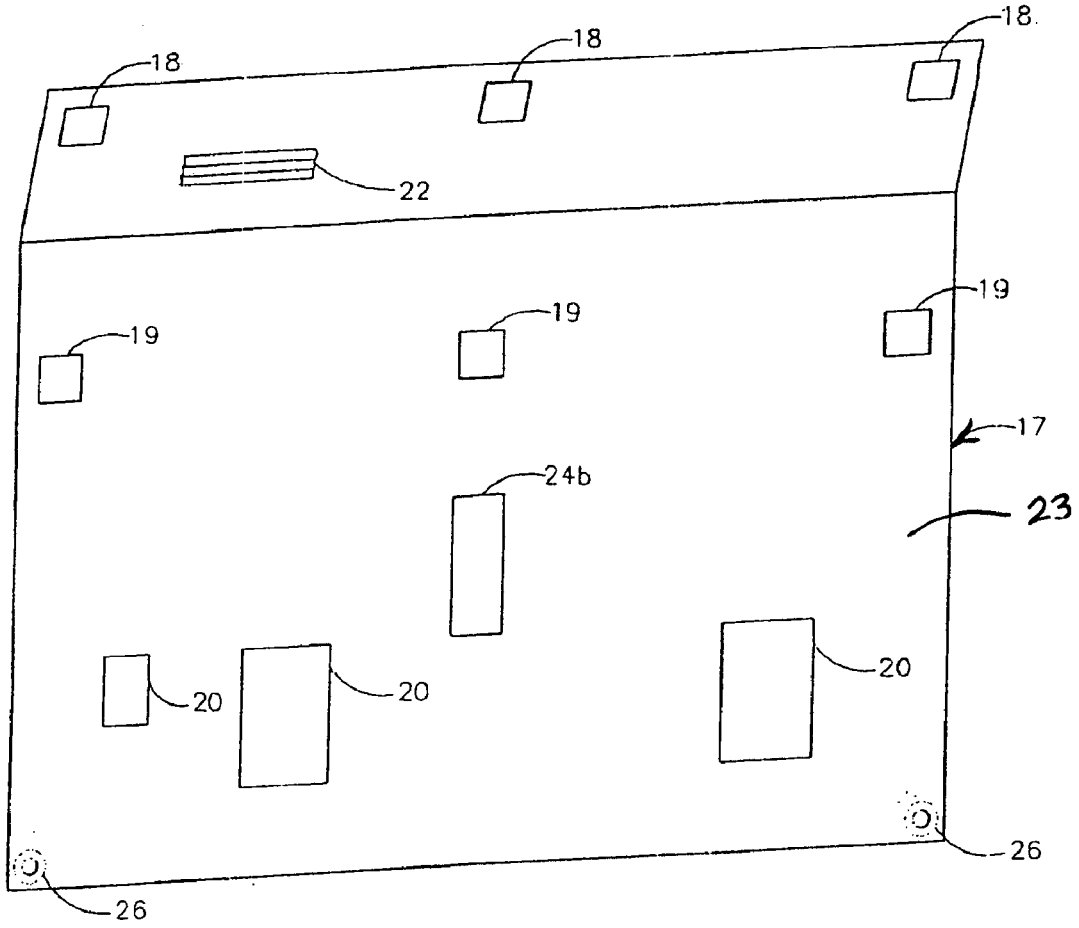

FIGURE THREE
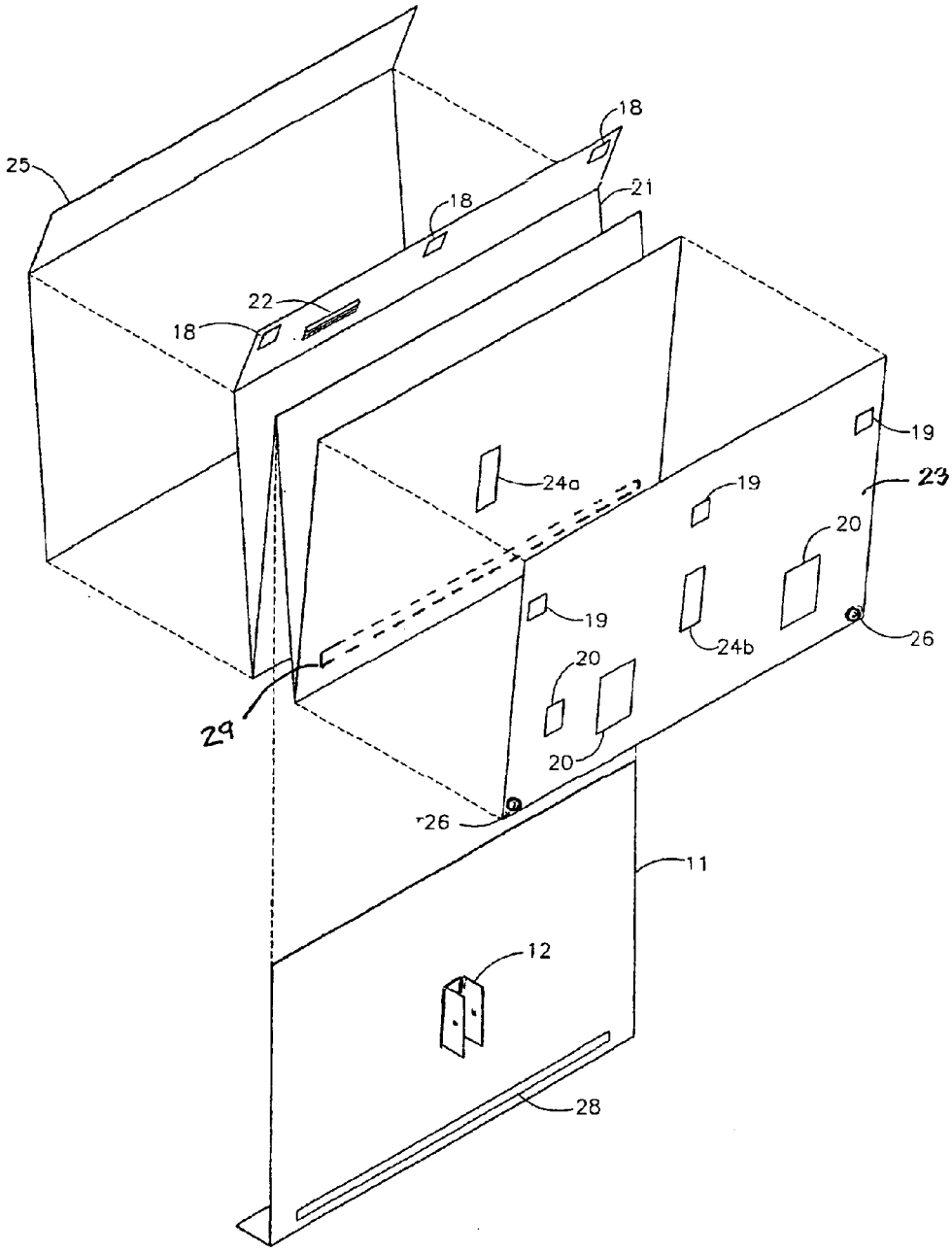

FIGURE FOUR
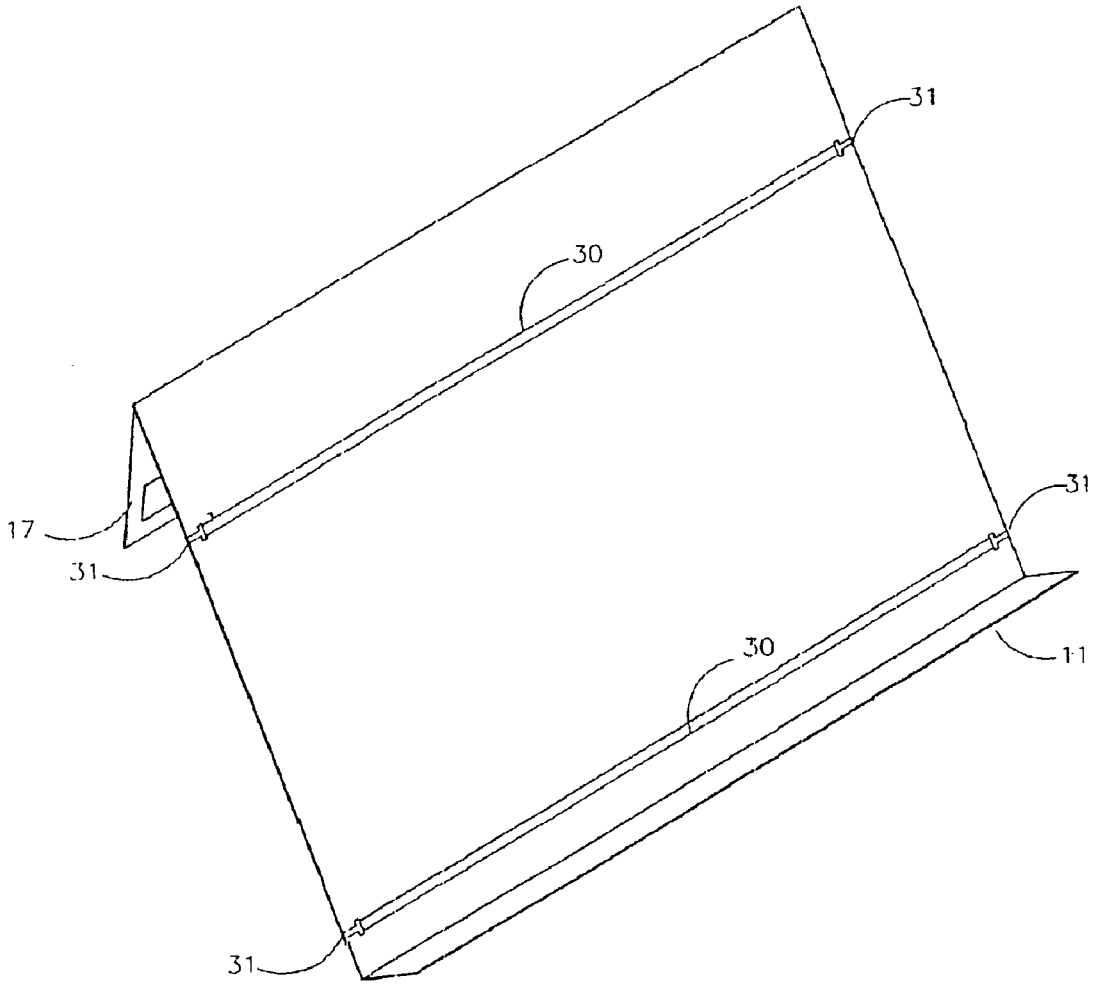

FIGURE FIVE
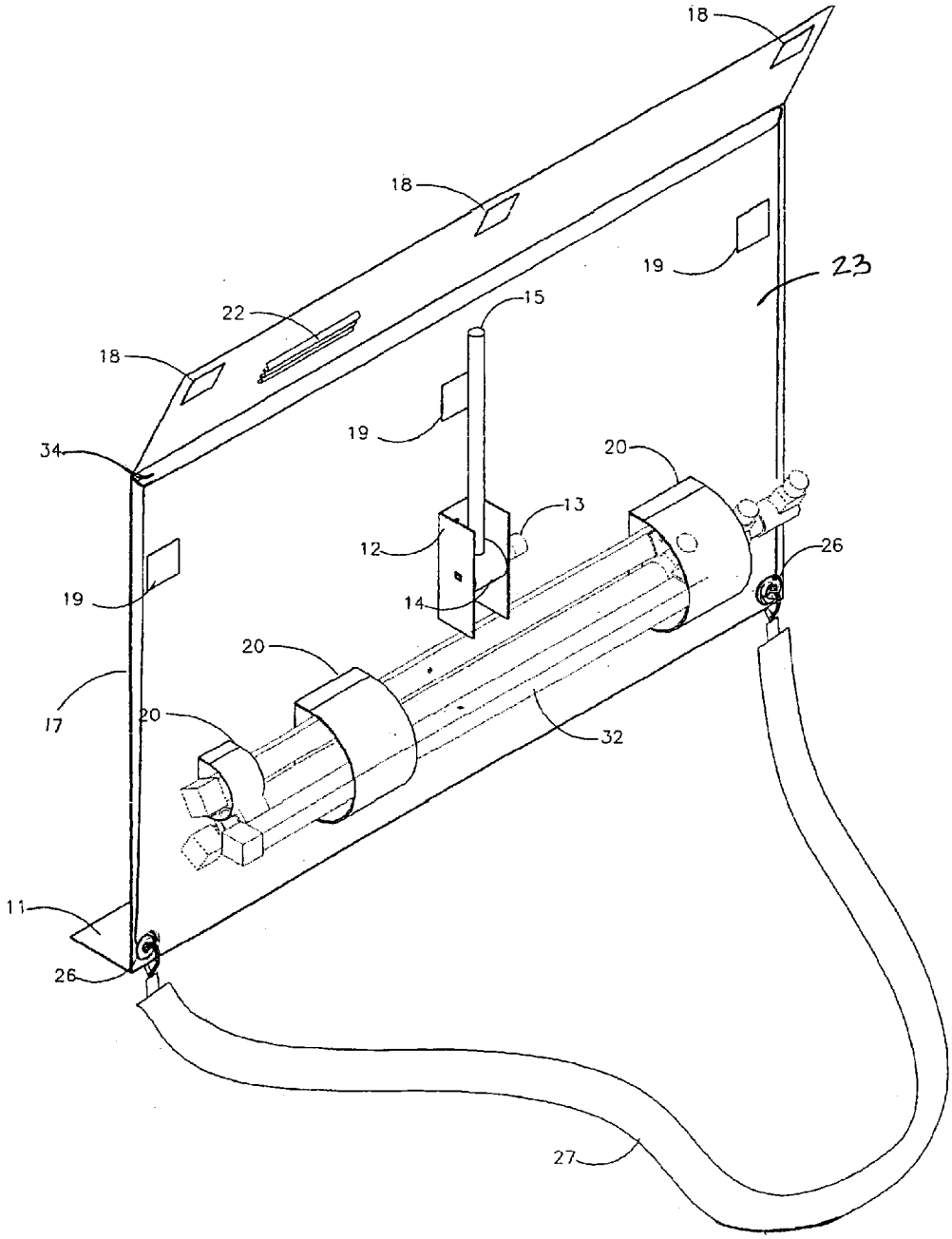

FIGURE SIX
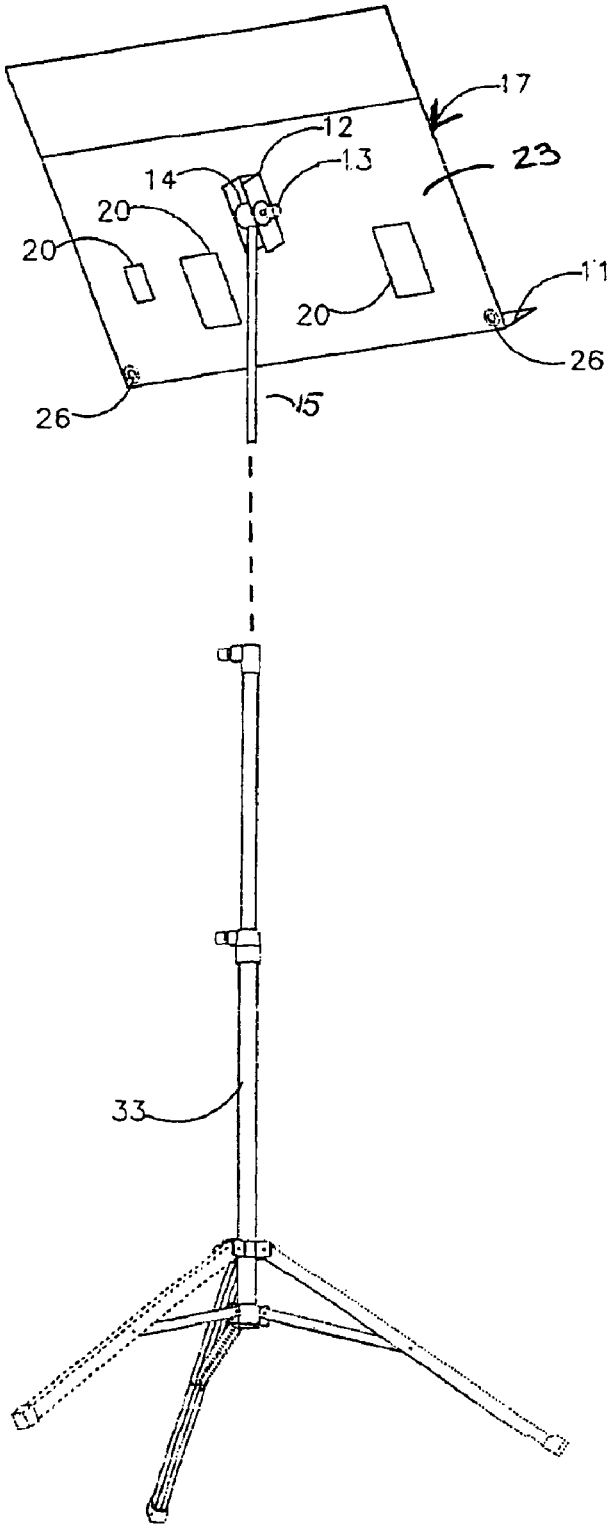

FIGURE SEVEN
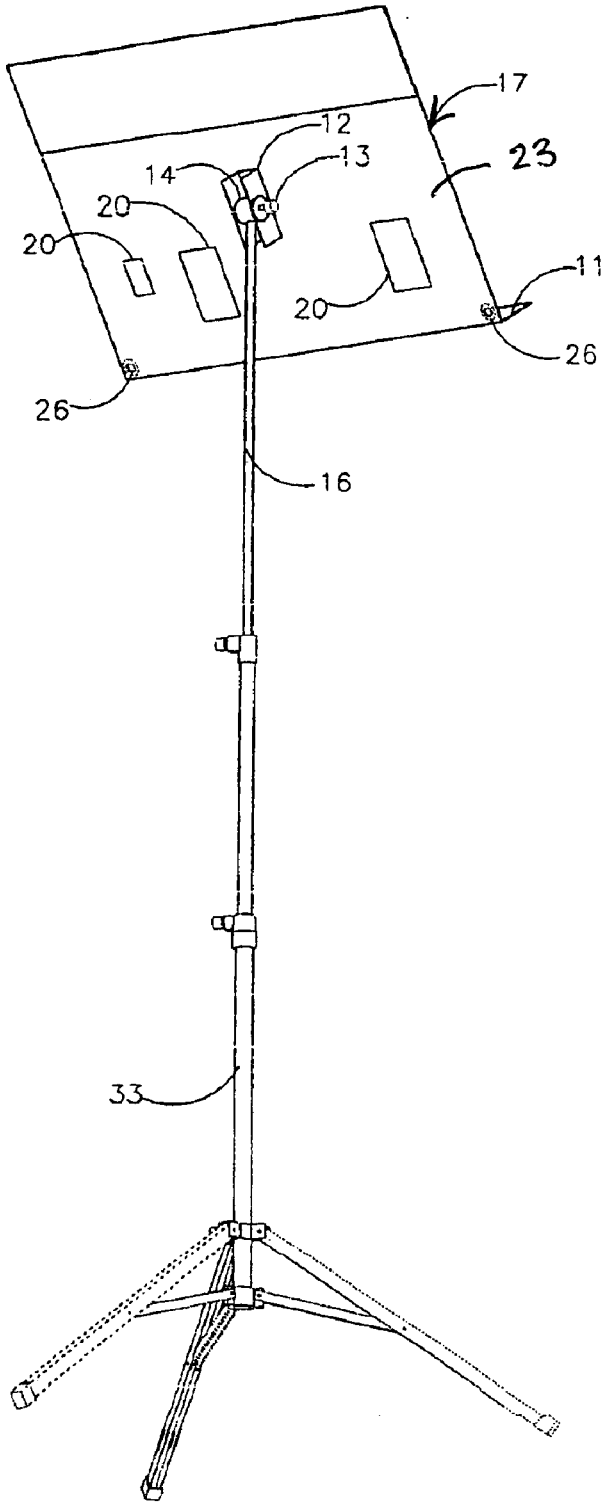

PORTABLE MUSIC STAND TOP AND CASE COMBINED

CROSS REFERENCE TO RELATED APPLICATIONS

This application is entitled to the benefit of Provisional Patent Application Ser. No. 60/308,258, filed Jul. 25, 2001.

BACKGROUND

1. Field of Invention

This invention relates to portable music stands, specifically to an improved portable music stand top whose case is also a shelf cover, designed to remain intact and look aesthetically appealing.

2. Descriptiom of Prior Art

Collapsibility and rigidity along with convenience have long been the desires of musicians regarding portable music stands.

Therefore, inventors have attempted several ways to meet these desired needs. U.S. Pat. No. 6,293,511 B1 to Shepherd (2001) discloses a collapsing music stand that disassembles into several parts that are intended for storage in a separate carrying bag. Although Shepherd's invention is self-containing it has inherent disadvantages. These include several loose parts that require excessive assembly and disassembly. Further, the storage mode requires a separate carrying bag with no means for transporting print music or accessories.

These disadvantages can be frustrating and inconvenient. Continuous setup and breakdown can lead to worn parts, misplaced parts or lost parts. The user may discard a separate carrying bag from time to time and henceforth increase the likelihood of lost or damaged parts.

Another invention, U.S. Pat. No. 5,564,661 to Gershon (1996) discloses a collapsing lectern or stand that has a separate case for storing music in combination with the stand for desired portability. The fact that the case is separate subjects the user to consider finding extra space for the case once they set up for playing. This can be compromising, especially when playing with ensembles or in situations where space is limited.

Still another invention, U.S. Pat. No. 5,713,553 to Cooper (1998) discloses a portable stand. Cooper's invention is designed to act like a carrying case when collapsed. When opened this invention appears awkward and clumsy.

SUMMARY OF THE INVENTION

The present invention, an improved portable music stand with a built in cover case combination that is subtle and appealing in appearance and accommodating in a plurality of ways for the user.

OBJECTS AND ADVANTAGES

Accordingly, several objects and advantages of the present invention are to provide an improved portable music stand that will conveniently store music and accessories. Another aspect of the present invention is a tabletop leg feature that is completely adjustable. Further, it is designed for intended use with a compatible support base, many of which currently exist.

Accordingly to another aspect of the present invention, the tabletop leg feature is interchangeable with a height extension rod. This height extension rod is intended to provide desirable height range when used with a support base. Still further objects and advantages will become apparent upon further study of the following description and accompanying drawings.

BRIEF DESCRIPTION OF DRAWING FIGURES

FIG. 1 is a rearview perspective of the shelf with itemized parts.

FIG. 2 is a rearview perspective of the shelf cover case assembled with itemized parts.

FIG. 3 is a rearview perspective of the shelf and cover case preassembled.

FIG. 4 is a frontal perspective of the present invention fully assembled with music secure straps FIG. 5 is a rearview perspective of the present invention fully assembled FIG. 6 is a rearview perspective of the present invention when used with a compatible base support.

FIG. 7 is a front view perspective of the present invention when used with the height extension rod.

REFERENCE NUMERALS

11 Shelf
12 Shelf Support Bracket
13 Carriage bolt
14 Leg Pivot Adaptor
15 Table Top Leg
16 Height Extension Rod
17 Shelf Cover Case
18 Flap Fastener Male
19 Flap Fastener Female
20 Support Base Storage Feature
21 Cover Case Pocket Liner
22 Writing Utensil Storage Feature
23 Cover Case Exterior Rear Panel
24 *a* Pocket Liner Bracket Reveal Hole
24 *b* Cover Case Bracket Reveal Hole
25 Cover Case Exterior Front Panel
26 Grommet
27 Shoulder Strap
28 Velcro "Hook" Fastener
29 Velcro "Loop" Fastener
30 Music Secure Strap
31 Secure Strap Hook
32 Example Tripod in Storage
33 Example Tripod in Use
34 Interior Pockets

DETAILED DESCRIPTION OF PREFERRED EMBODIMENT

FIG. 1 shows a shelf, 11, which is constructed of rigid material. 12 is a shelf support bracket made of rigid material. 14 and 15 are combined to create a tabletop leg. They have threaded ends and are constructed of rigid material. 16 is a height extension rod. This rod 16 is also threaded on one end and intended for interchangeability with the standard rod 15 where it connects to the leg pivot adapter 14. A carriage bolt 13 connects the tabletop leg 14 and 15 to the shelf support bracket 12. 28 is a strip of Velcro permanently applied.

Referring to FIGS. 2 and 3, the shelf cover case 17 is made of flexible sheet material. 18 and 19 are flap fasteners. 20 indicates three pieces of flexible material to accommodate a support base. Items 18, 19, 20 and 22 are permanently secured to the cover case 17, specifically the rear exterior panel 23. 24*a* and 24*b* are support bracket reveal holes centered on a pocket liner 21 and the rear exterior panel 23.

25 is an exterior front panel. 26, Grommets are secured to the two rear bottom comers of the assembled cover case 17.

FIG. 4 shows 30 and 31, music secure straps and fasteners assembled. These secure straps 30, are made of flexible material.

FIG. 5 shows the top reveal of interior pockets 34. 32 is an example of a compatible tripod in storage. Also, FIG. 5 shows a shoulder strap consisting of durable hook fasteners and strap material. FIG. 6 is an example of the present invention when used with a compatible support base 33.

The assembly of the cover case 17 is best seen in FIG. 3. The exterior panels 23 and 25 are joined to the pocket liner 21 on all outer edges allowing the interior pockets 34 to become apparent. The bottom center portion of the pocket liner 21 is not joined so as to create a sleeve for fitting over the shelf 11.

Advantages

From the description above, a number of advantages of my invention become evident.

a) The cover case feature 17 eliminates the need of an extra carrying bag for the music stand.

b) The tabletop leg 14 and 15 provides the user with alternative placement options. This is a very accommodating feature when space is limited or compromising.

c) The cover case interior pockets 34, provide room for traditional size music in the rear two pockets and also orchestral size scores in the oversized front pocket.

d) The writing utensil feature 22 and the tripod storage feature 20 provide convenient storage options.

e) A removable shoulder strap 27 makes it possible to display a clean and aesthetically appealing stand where appropriately desired.

f) The music secure straps 30 and 31 combined eliminate any concerns about material blowing off the stand. This is especially an issue when in use outdoors.

g) Many musicians can't find a portable stand tall enough. This issue is resolved by using the height extension rod 16. Further, this rod 16, conveniently fits inside the front pocket 34 of the cover case 17.

Operation

In Operation the user of the present invention will find virtually every functional need accommodated in a very convenient manner. Referring to FIG. 5 the preferred embodiment is shown where the majority of these advantages can be best seen. Starting with the shelf 11, the present invention is intended to display printed material, particularly but not limited to sheet music. The dimensions are determined in a way that orchestral size scores will be easily accommodated. Further, the shelf 11 is constructed of rigid sheet material to provide a firm foundation for display and also to withstand the rigors of transport.

The tabletop leg assembly consisting of 14 and 15 and best shown in FIGS. 1, 5 and 6, provides the user with several convenient advantages. First, it permits the invention to be used on alternative flat surfaces for situations where a support base is not practical. The leg pivot 14 is fastened to the shelf bracket 12 by way of a carriage bolt and nut 13. The carriage bolt and nut 13 allows the leg pivot 14 to move freely yet securely without the concern of loosening from the shelf support bracket 12. This design also allows for a free full range of tilt angles.

Another advantage of the leg assembly 14 and 15 is its ability to be used with a tripod support base 33 and best shown in FIG. 6. Although not a part of this present invention, there are several existing support bases on the market that are compatible to receive and secure the table top leg 15. Still another advantage to the leg feature 14 and 15 is a longer accessory rod 16 which is interchangeable with the tabletop leg 15. This height extension rod 16, offers a convenient way for standing users to be accommodated and can be best seen in FIG. 7.

The main objective of this present invention was to create a stand that will conveniently transport sheet music and accessories. This is accomplished by way of the shelf cover case design 17 best seen in FIGS. 3 and 5. Its advantages are numerous. It can store standard and orchestral size music scores. A writing utensil storage feature 22 is fastened in a secure and accessible location on the interior flap best shown on FIG. 5. A shoulder strap 27 can be applied and removed from the grommets 26 at the bottom comers of the shelf case cover 17. 18 and 19 are fasteners to ensure a discreet and secure closure. FIG. 3 shows a bracket reveal hole 24*a* and 24*b* that allows the shelf cover case 17 to be removed if desired. 28 is a strip of hook and loop Velcro fastened to the bottom interior of the rear panel 23 and 21 pocket liner assembled and also the bottom rear of the shelf 11, intended to create a removable seal between the shelf 11 and the shelf cover case 17.

FIG. 4 shows still another advantage of the present invention with music secure straps 30 and 31 respectively. These secure straps 30 are constructed of an expandable and contractible material with fasteners 31 on the ends. These secure straps allow easy manipulation for moving the items they are securing to the invention. They are designed to be completely adjustable and removable for preferred placement.

Overall, the present invention accomplishes all of the objectives considered in creating a desirable portable stand. Finally it is functionally convenient in more ways than any past or current inventions of this nature and is aesthetically appealing.

Conclusions, Ramifications and Scope of Invention

Thus the reader will see that the present invention provides a highly reliable, very considerate mode for displaying music whether at home or taking it abroad.

Although the description above contains much specificity, these should not be construed as limiting the scope of the invention but as merely providing illustrations of some of the presently preferred embodiments of this invention.

For example, the placement of the support base storage feature 20 can be changed to an additional pocket design or be fastened to the shelf lip on the front by way of fashioned clips, Velcro or straps.

The cover case 17 can be fastened with removable means other than hook and loop Velcro. Snaps, buttons or zippers are less preferable yet still possible alternatives.

The tabletop leg assembly 14 and 15 can be permanently connected to form one item. The same can be said about the height extension adaptor 16. It can be permanently fastened to a pivot piece 14, creating a different embodiment for interchanging with the tabletop leg assembly 14 and 15. The cover case pocket liner has 3 pocket features in the present invention but need not be restricted to that number.

Accordingly, the scope of the present invention should be determined not by the embodiment illustrated but by the appended claims and their legal equivalents.

I claim:

1. A portable stand comprising:

a shelf comprising a back plate having a front surface and a rear surface, and a flange extending from a bottom edge of the back plate;

a support bracket extending from the rear surface of the back plate; and a cover case including a sleeve having a front panel and a rear panel having a bracket reveal hole, the sleeve slideably fitted over the back plate and support bracket such that the support bracket extends through the bracket reveal hole, wherein the cover case further comprises a front pocket sharing the front panel of the sleeve and a rear pocket sharing the rear panel of the sleeve and having the bracket reveal hole through which the support bracket extends, the front and rear pockets each having an opening along a top edge of the shelf opposite the flange and the sleeve having an opening along the bottom edge of the shelf and configured to receive the back plate.

2. The portable stand of claim 1, further comprising:

a fastening system having at least one first member coupled to the shelf and at least one second member coupled to the cover case, wherein the at least one first member and the at least one second member are adapted to selectively fasten to one another to thereby selectively fasten the cover case to the shelf.

3. The portable stand of claim 1, wherein the sleeve and the front and rear pockets comprise a pliable material.

4. The portable stand of claim 1, wherein the cover case further includes a front exterior panel joined to the front pocket and a rear exterior panel joined to the rear pocket.

5. The portable stand of claim 4, wherein the front and rear exterior panels comprise a weather-resistant material.

6. The portable stand of claim 1, further including a carrying strap to facilitate transport of the portable stand by a user.

7. The portable stand of claim 6, wherein the carrying strap is selectively coupled to the cover case.

8. The portable stand of claim 1, wherein the cover case further comprises a storage system configured to selectively retain a support base.

9. The portable stand of claim 1, further comprising at least one secure strap configured to encompass the cover case to thereby secure a document against the cover case.

10. A portable stand comprising:

a shelf comprising a back plate having a front surface and a rear surface, and a flange extending from a bottom edge of the back plate;

a support bracket extending from the rear surface of the back plate; and a cover case including a sleeve having a front panel and a rear panel having a bracket reveal, the sleeve slideably fitted over the back plate and support bracket such that the support bracket extends through the bracket reveal hole; and a support mechanism configured to selectively couple to the support bracket, the support mechanism comprising:

a pivot mechanism configured to selectively couple to the support bracket; and a support member configured to selectively couple to the pivot mechanism.

11. The portable stand of claim 10, wherein the support member comprises a table leg configured to threadably couple to the pivot mechanism.

12. The portable stand of claim 10, wherein the support member comprises an extension rod configured to threadably couple to the pivot mechanism.

13. The portable stand of claim 10, further comprising a support base configured to selectively couple to the support mechanism.

14. The portable stand of claim 13, wherein the support base comprises a tripod.

15. A portable stand, suitable for use as a music stand, the portable stand comprising:

a shelf comprising:

a back plate having a front surface, a rear surface, an upper edge, and a lower edge; and a flange extending from the lower edge and outwardly from the front surface of the back plate;

a support bracket mounted to and extending from the rear surface; and p1 a cover case comprising:

a sleeve having a front panel and a rear panel;

a front pocket sharing the front panel of the sleeve; and a rear pocket sharing the rear panel of the sleeve and having a bracket reveal hole, the sleeve slideably fitted over the back plate and support bracket such that the support bracket extends through the bracket reveal hole.

16. The portable stand of claim 15, further comprising:

a carrying strap to facilitate transport of the portable music stand by a user.

17. The portable stand of claim 16, wherein the carrying strap is selectively coupled to the cover case.

18. The portable stand of claim 17, further comprising:

a pair of grommets located proximate to the lower edge of the shelf and extending through the front pocket and the rear pocket and configured to receive the carrying strap.

19. The portable stand of claim 15, further comprising:

a fastening system having at least one first member coupled to the back plate and at least one second member coupled to the cover case, wherein the at least one first member and the at least one second member are adapted to selectively fasten to one another to thereby selectively fasten the cover case to the shelf.

20. The portable stand of claim 15, wherein the cover case further includes a liner comprising:

a first, second, third, and fourth panel, each panel having a top edge, a bottom edge, a first side edge, and a second side edge, the third and fourth panels further including a bracket reveal hole, wherein the first side edges of each panel are joined together, the second side edges of each panel are joined together, the top edges of the second and third panels are joined together to form the sleeve, and the bottom edges of the first and second panels and the bottom edges of the third and fourth panels are joined together to respectively form the front and rear.

21. The portable stand of claim 20, wherein the bracket extending through the bracket reveal holes in the third and fourth panels divides the rear pocket into a pair of sub-pockets.

22. The portable stand of claim 21, wherein the front pocket has dimensions adequate to store orchestral size scores and the sub-pockets have dimensions adequate to store traditional size sheet music.

23. The portable stand of claim 20, wherein the liner comprises a continuous piece of pliable material.

24. The portable stand of claim 20, wherein the cover case further includes a weather-resistant outer shell comprising:

a first outer panel joined to each edge of the first liner panel on a surface opposite a surface shared with the second liner panel; and a second outer panel joined to each edge of the fourth liner panel on a surface opposite a surface shared with the third liner panel and having a bracket opening aligned with the support bracket location on the rear surface.

25. The portable stand of claim 24, wherein the cover case further comprises:

a flap formed by extending the first outer panel and first liner panel beyond the upper edge of the back plate, the flap configured to fold over the first and second pocket; and a flap fastening system having at least one first member coupled to a surface of the flap formed by the first liner panel and at least one second member coupled to a surface of the second outer panel opposite a surface shared with the fourth inner liner panel, wherein the at least one first member and the at least one second member are adapted to selectively fasten to one another to thereby secure the flap across the first and second pockets.

26. The portable stand of claim 15, further comprising a support mechanism configured to selectively couple to the support bracket.

27. The portable stand of claim 26, wherein the support mechanism comprises:

a pivot mechanism configured to selectively couple to the support bracket; and a support member configured to selectively couple to the pivot mechanism.

28. The portable stand of claim 27, wherein the support member comprises a table leg configured to threadably couple to the pivot mechanism.

29. The portable stand of claim 27, wherein the support member comprises an extension rod configured to threadably couple to the pivot mechanism.

30. The portable stand of claim 26, further comprising a support base configured to selectively couple to the support mechanism.

31. The portable stand of claim 30, wherein the support base comprises a tripod.

32. The portable stand of claim 15, wherein the cover case further comprises a storage system configured to selectively retain a storage base.

33. The portable stand of claim 15, wherein the cover case further includes a retaining system for storing utensils.

34. The portable stand of claim 15, further comprising at least one secure strap configured to encompass the cover case to thereby secure a document against the cover case.

35. A cover case for a portable stand having a shelf including a back plate and a support bracket extending therefrom, the cover case comprising:

a sleeve having a front panel and a rear panel;

a front pocket sharing the front panel of the sleeve;

a rear pocket sharing the rear panel of the sleeve and having a bracket reveal hole, the sleeve slideably fitted over the back plate and support bracket such that the support bracket extends through the bracket reveal hole; and a liner comprising a first, second, third, and fourth panel, each panel having a top edge, a bottom edge, a first side edge, and a second side edge, the third and fourth panels further including a bracket reveal hole, wherein the first side edges of each panel are joined together, the second side edges of each panel are joined together, the top edges of the second and third panels are joined together to form the sleeve, and the bottom edges of the first and second panels and the bottom edges of the third and fourth panels are joined together to respectively form the front and rear pockets.

36. The cover case of claim 35, further comprising:

a fastening system having at least one first member adapted to couple to the back plate and at least one second member coupled to the cover case, wherein the at least one first member and the at least one second member are adapted to selectively fasten to one another to thereby selectively fasten the cover case to the shelf.

37. The cover case of claim 35, wherein the bracket extending through the bracket reveal holes in the third and fourth panels divides the rear pocket into a pair of sub-pockets.

38. The cover case of claim 35, wherein the liner comprises a continuous piece of soft-textured fabric.

39. The cover case of claim 35, wherein the cover case further includes a weather-resistant outer shell comprising:

a first outer panel joined to each edge of the first liner panel on a surface opposite a surface shared with the second liner panel; and a second outer panel joined to each edge of the fourth liner panel on a surface opposite a surface shared with the third liner panel and having a bracket opening aligned with the support bracket location on the rear surface.

40. The cover case of claim 39, wherein the cover case further comprises:

a flap formed by extending the first outer panel and first liner panel beyond the upper edge of the back plate, the flap configured to fold over the first and second pocket; and a flap fastening system having at least one first member coupled to a surface of the flap formed by the first liner panel and at least one second member coupled to a surface of the second outer panel opposite a surface shared with the fourth inner liner panel, wherein the at least one first member and the at least one second member are adapted to selectively fasten to one another to thereby secure the flap across the first sand second pockets.

41. The cover case of claim 35, further comprising a carrying strap selectively coupled to the cover case to facilitate transport of the cover case by a user.

42. The cover case of claim 41, further comprising a pair of grommets configured to receive the carrying strap.

43. The cover case of claim 35, wherein the cover case further comprises a storage system configured to selectively retain a storage base.

44. The cover case of claim 35, wherein the cover case further includes a retaining system for storing utensils.

* * * * *